US006520341B2

(12) United States Patent
Suter et al.

(10) Patent No.: US 6,520,341 B2
(45) Date of Patent: Feb. 18, 2003

(54) SCREEN TENSIONING DEVICE AND METHOD FOR A VIBRATING SCREEN SEPARATOR

(75) Inventors: Roger Suter, Houston, TX (US); Gary Fout, Cypress, TX (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 09/837,131

(22) Filed: Apr. 18, 2001

(65) Prior Publication Data

US 2002/0153289 A1 Oct. 24, 2002

(51) Int. Cl.[7] ..... B07B 1/49
(52) U.S. Cl. ..... 209/405; 209/363
(58) Field of Search ..... 209/405, 363

(56) References Cited

U.S. PATENT DOCUMENTS

| | | | |
|---|---|---|---|
| 2,804,208 | A | 8/1957 | Hardefeld et al. |
| 2,985,303 | A | 5/1961 | Wright |
| 3,156,643 | A | 11/1964 | Wright, Jr. et al. |
| 4,018,104 | A | 4/1977 | Bland et al. |
| 4,319,992 | A | 3/1982 | Davis et al. |
| 4,392,686 | A | 7/1983 | Beer |
| 4,555,330 | A | 11/1985 | Tsutsumi et al. |
| 5,332,101 | A | 7/1994 | Bakula |
| 5,772,351 | A | 6/1998 | Ching |
| 5,867,872 | A | 2/1999 | Katoh |

*Primary Examiner*—Donald P. Walsh
*Assistant Examiner*—Jonathan R Miller
(74) *Attorney, Agent, or Firm*—Haynes and Boone, LLP

(57) ABSTRACT

An embodiment of the present invention, accordingly, is directed to a tensioning device for tensioning a screen relative to a wall of a separator in a manner so that the proper tension can be applied to the screen in a relatively quick manner and yet the screen can be easily removed and a new one installed.

22 Claims, 3 Drawing Sheets

SCREEN TENSIONING DEVICE AND METHOD FOR A VIBRATING SCREEN SEPARATOR

BACKGROUND OF THE INVENTION

This invention relates to a vibrating screen separator and, more particularly, to such a separator utilizing a device for tensioning a separation screen on a vibrating bed for separating solids of different sizes or for separating solids from a liquid.

A typical screen separator consists of an elongated, box-like, rigid bed, and a tensioned screen attached to, and extending across, the bed. The bed is vibrated as the material to be separated is introduced to the screen so that the liquid and/or relatively small sized material passes through the screen; while the relatively large sized material is maintained on the upper surface of the screen and conveyed to the discharge end of the bed for discharge. The bed can be vibrated by pneumatic, hydraulic, or rotary vibrators, in a conventional manner.

In these type arrangements, if the screen is not stretched correctly, i.e., if the proper tension is not applied to the screen, it will not properly separate the material discussed above and will often throw fluid and wear out quickly. Also, it is difficult to apply the proper tension to the screen, yet permit it to be easily removed for replacement.

Although several devices have evolved that are designed to apply tension to the screen, they suffer from several disadvantages. For example, they are difficult to use, take an inordinate amount of time, and are generally unsuitable to the hostile environment in which vibrating screen separators are often used. Also, some of these devices easily come out of adjustment and it is often difficult and time-consuming to replace them should they fail or wear out. Still further, many of these devices use a clamping force provided by air pressure, which is not always available, and use relatively small parts that can be lost, damaged or become out of adjustment.

Therefore, what is needed is a device for applying a relatively precise amount of tension to the screen of a screen separator that eliminates the problems set forth above.

SUMMARY OF THE INVENTION

An embodiment of the present invention, accordingly, is directed to a tensioning device for tensioning a screen relative to a wall of a separator in a manner so that the proper tension can be applied to the screen in a relatively quick manner and yet the screen can be easily removed and a new one installed.

DETAILED DESCRIPTION OF THE PREFERRED EMBODIMENT

Figure 1:
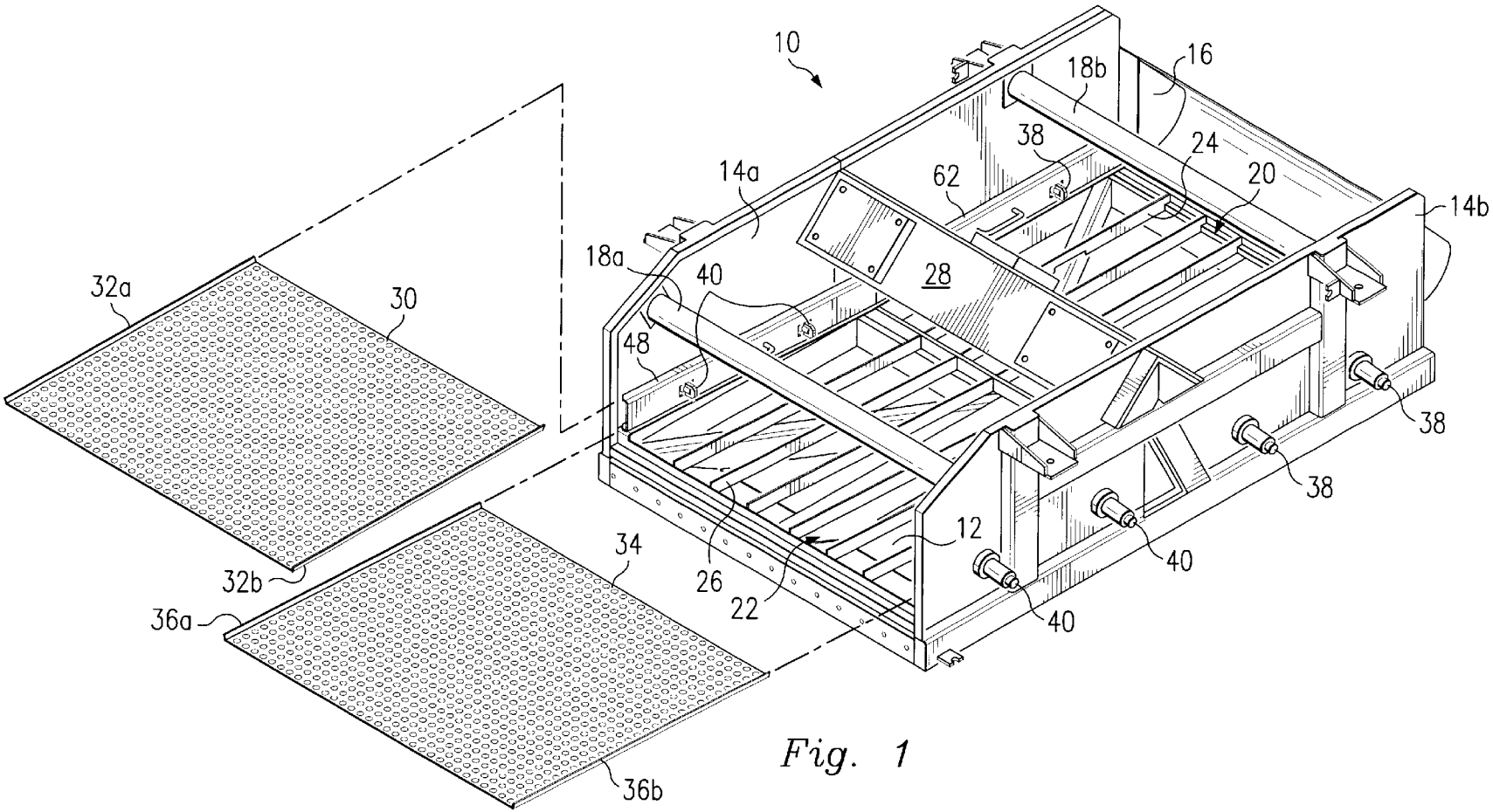
FIG. 1 is an exploded isometric view of a vibrating screen separator according to an embodiment of the present invention.

An embodiment of the separator Of the present invention is shown in FIG. 1 of the drawings, and includes an open housing, or bed, 10 having a floor, or bottom wall 12, and two side walls 14*a* and 14*b* that are respectively connected to the longitudinal edges of the bottom wall and extend perpendicularly thereto. A rear wall 16 is connected to the rear edge of the bottom wall 12 and to the rear ends of the side walls 14*a* and 14*b*, and also extends perpendicularly to the bottom wall.

Two cross braces 18*a* and 18*b* extend between the side walls 14*a* and 14*b* and above the bottom wall 12. The cross braces 18*a* and 18*b* are connected to the side walls 14*a* and 14*b* in any known manner and function to add strength and rigidity to the bed 10.

A horizontally extending deck 20 is mounted in the feed, or rear, end of the bed 10 in a spaced relationship to the bottom wall 12 of the bed; and a horizontally extending deck 22 is mounted in the discharge, or front end, of the bed 10 and is spaced from the bottom wall 12. The deck 20 is formed by a plurality of spaced elongated plates or grids 24, and the deck 22 is formed by a plurality of spaced horizontal plates or grids 26. Each deck 20 and 22 extends for approximately one-half the length, or depth, of the bed 10.

A vibrator tube assembly 28 extends between the walls 14*a* and 14*b* and is mounted to the walls in any conventional manner. The assembly 28 includes conventional vibration motors (not shown) that, when activated, vibrate the bed 10 for reasons to be described.

Figure 2:
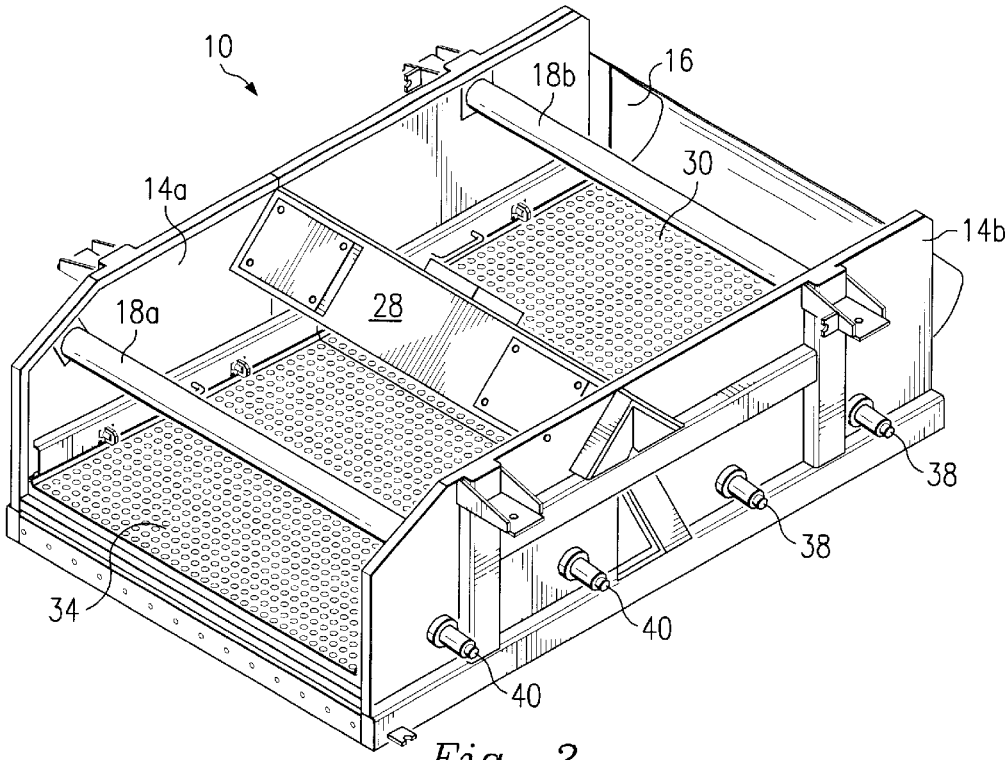
FIG. 2 is a view similar to that of FIG. 1 but depicting the separator in an assembled condition.

A screen 30 is provided and is fabricated from a material that passes liquid and very small solid particles, while retaining larger particles of a certain size. Two spaced hook strips 32*a* and 32*b* are respectively connected to the lateral edge portions of the screen 30 in any conventional manner and are mounted to the walls 14*a* and 14*b*, respectively, in a manner to be described. As shown in FIG. 2, the screen 30 is provided in the feed, or rear, portion of the bed 10 and rests on, and is thus supported by, the deck 20. The width of the screen 30 is slightly less that the distance between the inner surfaces of the side walls 14*a* and 14*b*. In the installed position of the screen 30 shown in FIG. 2, it extends in the feed, or rear, portion of the bed 10 for approximately one-half the length, or depth, of the bed with its rear edge abutting the inner surface of the rear wall 16.

A screen 34 is also provided which is identical to the screen 30. Two spaced hook strips 36*a* and 36*b* are respectively connected to the lateral edge portions of the screen 34 in any conventional manner and are mounted to the walls 14*a* and 14*b*, respectively, in a manner to be described. As shown in FIG. 2, the screen 34 is provided in the discharge, or front, portion of the bed 10 and rests on, and is supported by, the deck 22. The width of the screen 34 is slightly less that the distance between the inner surfaces of the side walls 14*a* and 14*b*. In the installed position of the screen 34 shown in FIG. 2, it extends in the discharge, or front, portion of the bed 10 for approximately one-half the length, or depth, of the bed with its front end extending substantially flush with the front end of the bed 10.

Two spaced tensioning devices 38 are mounted to the rear portion of each side wall 14*a* and 14*b*, with a portion of each device extending through the wall, for tensioning the screen 30 in the rear portion of the bed 10. Similarly, two spaced tensioning devices 40 are mounted to the front portion of each side wall 14*a* and 14*b*, with a portion of each device extending through the wall, for tensioning the screen 34 in the front portion of the bed 10.

Figure 3:
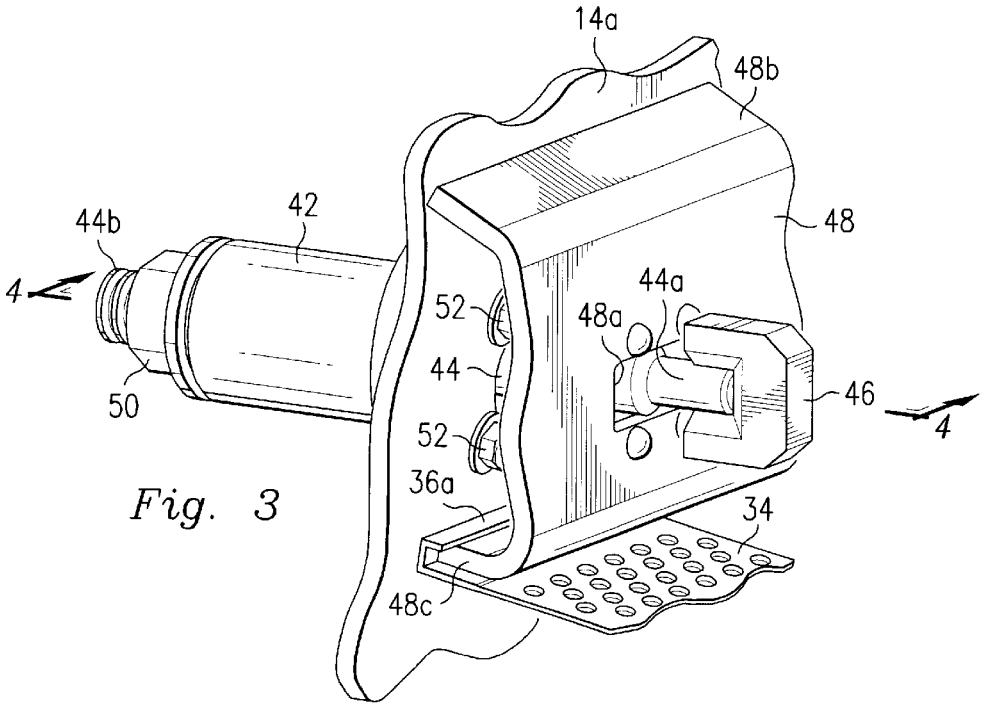
FIG. 3 is an enlarged isometric view of one of the tensioning devices of FIGS. 1 and 2.

One of the tensioning devices 40 associated with the wall 14*a* is shown in better detail in FIG. 3. The device 40 includes a substantially cylindrical housing 42 mounted to the outer surface of the wall 14*a* in a manner to be described and having a tension bolt 44 extending though the length thereof. One end portion 44*a* of the bolt 44 projects from an end of the housing 42 and extends through an opening in the side wall 14*a*, and a tab 46 is welded, or otherwise fastened, to the latter end of the bolt.

A tension rail 48 extends over the inner surface of the side wall 14*a*, and a slot 48*a* is formed through a portion of the rail through which the end portion 44*a* of the bolt 44 extends. The tab 46 has a substantially rectangular shape with a width that is greater than the width of the slot 48*a* and less than the length of the slot; and a thickness that is less than of the width of the slot 48*a*. This enables tab 46 to be inserted through the slot and then rotated approximately 90 degrees to the position shown to capture the rail 48 between the tab and the wall 14*a*.

One end 48*b* of the rail 48 rests against the wall 14*a* and establishes a fulcrum point for pivotal movement of the rail 48 under conditions to be described. The other end portion 48*c* of the rail 48 is bent at an approximately ninety degree angle with the end of the bent portion extending in the hook strip 36*a* of the screen 34. The rail 48 extends from the front, or discharge, end of the bed 10 to an area approximately midway between the front and the rear of the bed, and it is understood that a rail, identical to the rail 48 rests against the wall 14*b* in a similar manner.

The other end portion 44*b* of the bolt 44 projects from the other end of the housing 42, is externally threaded, and receives a nut 50 which extends between the end of the bolt and the housing. The housing 42, the bolt 44, and the nut 50 thus form an actuator which enables the nut to be rotated to cause relative movement of the bolt under conditions to be described.

Figure 4:
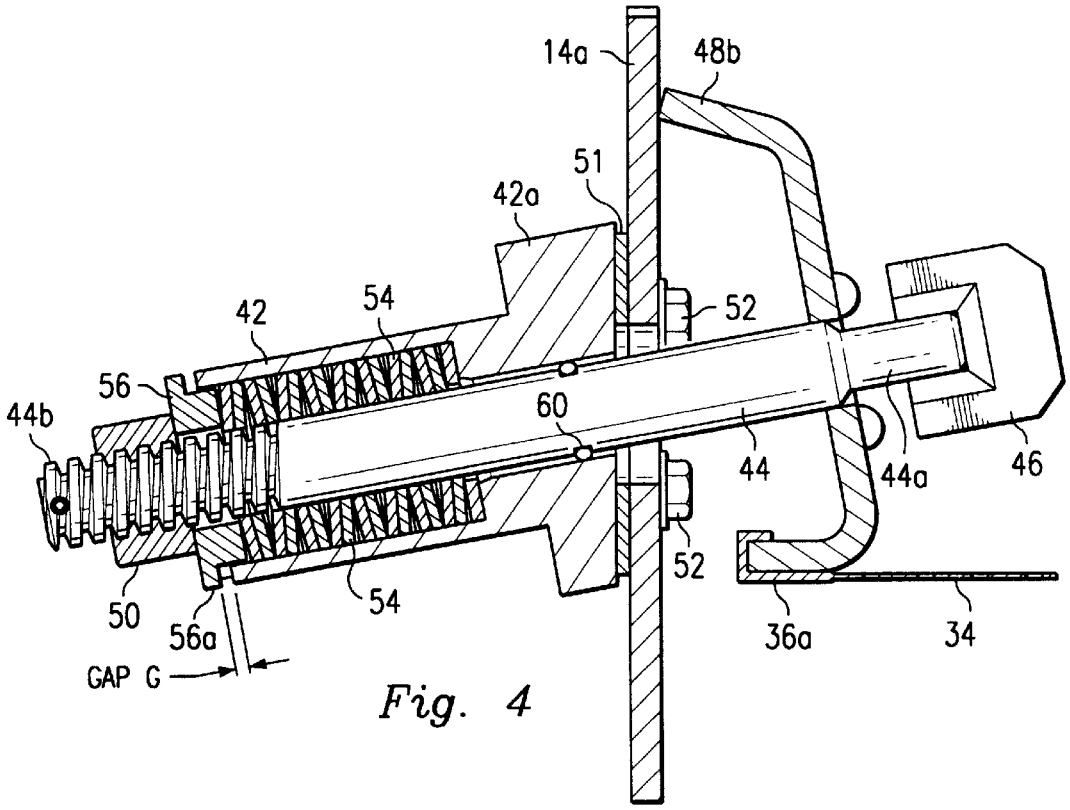
FIG. 4 is a sectional view taken along the line 4—4 of FIG. 1.

Referring to FIG. 4, the end portion of the housing 42 adjacent the wall 14*a* is enlarged to form an annular flange 42*a*, and a gasket 51 extends between the latter end portion and the corresponding surface of the wall. Four bolts 52, two of which are shown in FIG. 4, extend through corresponding openings formed in the wall 14*a* and the housing 42 to mount the housing 42 to the outer surface of the wall.

A stepped bore is formed in the interior of the housing 42 and a series of sixteen stacked belleville spring washers 54 extend around the bolt 44 and are disposed in the larger-diameter portion of the latter bore. The spring washers 54 are conventional and are designed to develop a spring tension in response to an axial, compressive load being applied thereto, as will be described.

A ring-shaped retainer 56 extends between the nut 50 and the corresponding end washer 54, with a portion of the retainer extending in the corresponding end of the housing 42. The retainer 56 has an annular, radially-extending, flange 56*a* extending from one end thereof and disposed externally of the housing 42. The design is such that, when the washers 54 are in their non-compressed state as shown in FIG. 4, they urge the flange 56*a* outwardly a slight distance from the corresponding end of the housing 42 to form a gap G.

A seal ring 60 is disposed in an annular groove formed in the outer surface of the bolt and engages a corresponding inner surface of the housing. When the separator is used for separating solids from a liquid the seal ring functions to prevent the egress of any liquid from the bed 10.

In operation, the screens 30 and 34 are placed on the decks 20 and 22, respectively, and the rail 48 is attached to the screen 34 in the manner described above, with some slack being maintained in the screen 34, and the nut 50 is backed off from the retainer ring 56. In this position, the spring washers 54 are in their relaxed, non-compressed, state thus forcing the retainer ring in an axial direction away from the corresponding end of the housing 42 as shown in FIG. 4 to form the gap G.

The nut 50 is then rotated to advance it until it engages the retainer ring 56. Upon further rotation of the nut 50, any further axial movement of the nut along the bolt is resisted by the spring washers 54, thus causing the bolt 44 to translate in a direction from right-to-left, as viewed in FIG. 4, i.e. in a direction that shortens the effective length of the bolt. This causes the rail 48 to pivot about the above-mentioned fulcrum so that the remaining portion of the rail, and therefore the strut 36*a* of the screen 34, move towards the wall 14*a*. This rotation of the nut 50 thus applies a tension to the screen 34.

This screen tension thus creates an axial force opposite to the axial force applied to the nut 50 by the spring washers 54. Thus, further rotation of the nut 50 results in it advancing slightly along the rod 44, thus pushing the retainer ring 56 towards the corresponding end of the housing 42, narrowing the gap G, and compressing the spring washers 54 to increase the resulting axial spring force exerted by the washers. Of course, the above oppositely-directed forces continuously vary in a non-linear manner as the tension on the screen 34 varies and as the load on the spring washers 54 vary. Therefore, as the nut 50 is rotated, the rod 44 moves relative to the nut to increase the force caused by the screen tension, and the nut moves relative to the rod to compress the spring washers and thus increase the force caused by their spring tension.

The system is designed so that when the flange 56*a* of the retainer ring 56 engages the end of the housing 42, a predetermined, precise tension will be applied to the screen 34 which corresponds to the desired tension for use in the separating process discussed above. Of course, if it is desired to vary this tension, the number of washers 54 that are used (or the spring tension of the washers) can be varied accordingly.

As shown in FIGS. 1 and 2 the rail 48 extends for the depth of the deck 20 and receives two of the tensioning devices 40 including the one described above. Also, a rail 62 is disposed on the deck 22 and adjacent the rear portion of the wall 14*a* for receiving two of the tensioning devices 38. Although not shown in the drawings, it is understood that an additional rail is disposed on the deck 20 and extends adjacent the wall 14*b* and opposite the rail 48 for receiving two additional tensioning devices 40; and an additional rail is disposed on the deck 22 and extends adjacent the wall 14*b* and opposite the rail 62 for receiving two additional tensioning devices 38. All of the tensioning devices 38 and 40 function in an identical manner as described above so that the precise tension is applied to the screens 30 and 34 uniformly across the bed 10.

After the screens 30 and 34 have been tensioned in the above manner, the bed 10 is vibrated by the vibration motors in the vibrating tube assembly 28 in a conventional manner. The material to be separated is introduced to the feed, or rear, end of the bed onto the screen 30 which functions to retain the relatively large size material and passes the liquid and/or relatively small sized material for disposal or transfer to other equipment. The vibration of the bed 10 also causes the relatively large size material to advance in a direction from the feed, or rear, end of the bed to the discharge, or front end of the bed and from the screen 30 to the screen 34. The screen 34 functions in the same manner as the screen 30 before the relatively large size material is discharged from the screen 34 and from the bed.

The above embodiment also enjoys several advantages. For example, the proper tension is applied to the screens in a relatively quick manner, yet the screens can be easily removed and replaced. Also, the tensioning devices are durable and reliable yet can be used in relatively hostile environments. Further, they do not require relatively small parts or pressurized air to operate.

It is understood that several variations may be made in the foregoing without departing from the scope of the invention. For example, the number of screens and tensioning devices can be varied within the scope of the invention. Also, the washers 54 can be replaced with any variable resistance device such as a spring, etc. Further, the references, such as "front", "rear", "upper", "feed", "discharge", "lower", "above", "below", "above", etc are made for the purpose of example only and are not for the purpose of limiting the spatial orientation of any of the components discussed above.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A separator comprising a bed comprising a plurality of walls, a screen supported in the bed, a housing disposed adjacent one of the walls, a bolt member connected to the screen and adapted for translational movement relative to the housing, a rotating member in threaded engagement with the bolt member for receiving torque, spring means for applying an axial force against the rotating member so that rotation of the rotating member in a first direction causes relative translational movement between the rotating member and the bolt member to apply a tension to the screen, and rotation of the rotating member in a second direction causes relative translational movement between the rotating member and the bolt member to release tension on the screen, and means for limiting the translational movement of one of the members in response to a predetermined tension on the screen.

2. The separator of claim 1 further comprising a rail disposed adjacent the wall and engaging the screen, the rail adapted to receive the bolt member so that the translational movement of the bolt member moves the rail and applies the tension to the screen.

3. The separator of claim 2 wherein the housing is mounted to the outer surface of the wall and the rail extends over the inner surface of the wall.

4. The separator of claim 3 wherein the bolt member extends through an opening in the wall.

5. The separator of claim 2 wherein one end of the rail engages the inner surface of the wall and establishes a fulcrum for pivotal movement of the rail relative to the wall.

6. The separator of claim 1 wherein an end portion of the bolt member is externally threaded and wherein the rotating member is a nut.

7. The separator of claim 6 wherein the other end of the bolt member is connected to the screen.

8. The separator of claim 1 wherein the tension of the screen creates a force that is opposite to the axial force exerted by the spring means so that, as the rotating member is rotated in the first direction, the bolt member moves relative to the rotating member to increase the force caused by the screen tension, and the rotating member moves relative to the bolt member to increase the force caused by the spring tension, and as the rotating member is rotated in the second direction, the bolt member moves relative to the rotating member to decrease the force caused by the screen tension, and the rotating member moves relative to the bolt member to decrease the force caused by the spring tension.

9. A method for tensioning a screen relative to a wall of a separator, the method comprising the steps of connecting a housing to the wall, mounting a bolt member for reciprocal translational movement relative to the housing, connecting one end of the bolt member to the screen, threadedly engaging a rotating member with the other end of the bolt member so that rotation of the rotating member causes relative translational movement between the rotating member and the bolt member, applying an axial force against the rotating member, rotating the rotating member in a first direction to cause corresponding relative translational movement between the rotating member and the bolt member to apply a tension to the screen, rotating the rotating member in a second direction to cause corresponding relative translational movement between the rotating member and the bolt member to release tension on the screen, and limiting the translational movement of one of the members in response to a predetermined tension on the screen.

10. The method of claim 9 further comprising the step of pivotally mounting a rail to the wall, connecting the rail to the screen and to the bolt member so that the translational movement of the bolt member pivots the rail and applies the tension to the screen.

11. The method of claim 10 wherein one end of the rail engages the inner surface of the wall and establishes a fulcrum for pivotal movement of the rail relative to the wall.

12. The method of claim 11 wherein an end portion of the bolt member is externally threaded and wherein the rotating member is a nut.

13. The method of claim 12 wherein the other end of the bolt member is connected to the screen.

14. The method of claim 9 wherein the tension of the screen creates a force that is opposite to the axial force exerted by the spring means so that, as the rotating member is rotated, the bolt member moves relative to the rotating member to increase the force caused by the screen tension, and the rotating member moves relative to the bolt member to increase the force caused by the spring tension.

15. A device for applying tension to a screen extending between at least two walls, the device comprising a housing disposed adjacent the wall, a bolt member connected to the screen and adapted for translational movement relative to the housing, a rotating member in threaded engagement with the bolt member for receiving torque, spring means for applying an axial force against the rotating member so that rotation of the rotating member in a first direction causes relative translational movement between the rotating member and the bolt member to apply a tension to the screen, and rotation of the rotating member in a second direction causes relative translational movement between the rotating member and the bolt member to release tension on the screen, and means for limiting the translational movement of one of the members in response to a predetermined tension on the screen.

16. The device of claim 15 further comprising a rail disposed adjacent the wall and engaging the screen, the rail adapted to receive the bolt member so that the translational movement of the bolt member moves the rail and applies the tension to the screen.

17. The device of claim 16 wherein the housing is mounted to the outer surface of the one wall and the rail extends over the inner surface of the one wall.

18. The device of claim 17 wherein the bolt member extends through an opening in the one wall.

19. The device of claim 16 wherein one end of the rail engages the inner surface of the one wall and establishes a fulcrum for pivotal movement of the rail relative to the one wall.

20. The device of claim 15 wherein an end portion of the bolt member is externally threaded and wherein the rotating member is a nut.

21. The device of claim 20 wherein the other end of the bolt member is connected to the screen.

22. The device of claim 15 wherein the tension of the screen creates a force that is opposite to the axial force exerted by the spring means so that, as the rotating member is rotated, the bolt member moves relative to the rotating member to increase the force caused by the screen tension, and the rotating member moves relative to the bolt member to increase the force caused by the spring tension.

* * * * *

UNITED STATES PATENT AND TRADEMARK OFFICE

CERTIFICATE OF CORRECTION

PATENT NO. : 6,520,341 B2
DATED : February 18, 2003
INVENTOR(S) : Roger Suter and Gary Fout It is certified that error appears in the above-identified patent and that said Letters Patent is hereby corrected as shown below:

Column 3,
Line 59, after "the bolt" insert -- 44 --
Line 60, after "housing" insert -- 42 --

Column 4,
Line 13, delete "strut" replace with -- hook strip --
Lines 40 and 45, delete "deck 20" replace with -- deck 22 --
Lines 42 and 48, delete "deck 22" replace with -- deck 20 --

Signed and Sealed this

Twenty-third Day of September, 2003

JAMES E. ROGAN
*Director of the United States Patent and Trademark Office*